US010309642B2

(12) United States Patent
Collins et al.

(10) Patent No.: US 10,309,642 B2
(45) Date of Patent: Jun. 4, 2019

(54) PROCESS FOR RECOVERING POWER IN A PROCESS FOR PRODUCING ETHYLENE

(71) Applicant: SHELL OIL COMPANY, Houston, TX (US)

(72) Inventors: David Michael Collins, Amsterdam (NL); Ankit Singhal, Bangalore (IN)

(73) Assignee: SHELL OIL COMPANY, Houston, TX (US)

( * ) Notice: Subject to any disclaimer, the term of this patent is extended or adjusted under 35 U.S.C. 154(b) by 30 days.

(21) Appl. No.: 14/418,963

(22) PCT Filed: Aug. 1, 2013

(86) PCT No.: PCT/EP2013/066202
§ 371 (c)(1),
(2) Date: Feb. 2, 2015

(87) PCT Pub. No.: WO2014/020115
PCT Pub. Date: Feb. 6, 2014

(65) Prior Publication Data

US 2015/0292732 A1 Oct. 15, 2015

(30) Foreign Application Priority Data

Aug. 3, 2012 (EP) ..... 12179210

(51) Int. Cl.
*C10G 9/00* (2006.01)
*C10G 9/20* (2006.01)
(Continued)

(52) U.S. Cl.
CPC ..... *F22B 1/1838* (2013.01); *C10G 9/002* (2013.01); *C10G 9/20* (2013.01); *C10G 9/36* (2013.01);
(Continued)

(58) Field of Classification Search
CPC ..... F01K 23/064; C10G 9/002
(Continued)

(56) References Cited

U.S. PATENT DOCUMENTS 2,245,819 A * 6/1941 Porter ..... C10G 69/06 208/130
3,518,830 A * 7/1970 Dunnavant ..... F01K 3/265 60/653
(Continued)

FOREIGN PATENT DOCUMENTS

CN 86108633 7/1987
CN 1037377 11/1989
(Continued)

*Primary Examiner* — Laert Dounis

(57) ABSTRACT

The present invention provides a process for power recovery in a process for producing ethylene, comprising steam cracking a hydrocarbon feed to produce a cracked gas product; cooling the cracked gas product by indirect heat exchange with high pressure liquid water to obtain cooled cracked gas product while evaporating the high pressure liquid water to high pressure steam; expanding the high pressure steam in a first steam expansion turbine to produce power and to obtain medium pressure steam; heating at least part of the medium pressure steam to increase the temperature of the medium pressure steam by passing the medium pressure steam through a convection zone of the cracking furnace and retrieving reheated medium pressure steam from the convection zone; expanding at least part of the reheated medium pressure steam in a second steam expansion turbine to produce power and to obtain low pressure steam.

15 Claims, 1 Drawing Sheet

(51) Int. Cl.

| | |
|---|---|
| ***C10G 9/36*** | (2006.01) |
| ***F01K 7/22*** | (2006.01) |
| ***F22B 1/18*** | (2006.01) |
| ***F01K 13/00*** | (2006.01) |
| ***F01K 23/06*** | (2006.01) |

(52) U.S. Cl.
CPC ..... *F01K 7/22* (2013.01); *F01K 13/006* (2013.01); *F01K 23/064* (2013.01); *C10G 2400/20* (2013.01)

(58) Field of Classification Search
USPC ..... 60/653, 655, 676, 679
See application file for complete search history.

(56) References Cited

U.S. PATENT DOCUMENTS

| | | | | | |
|---|---|---|---|---|---|
| 4,164,848 | A * | 8/1979 | Gilli | F01K 3/14 | 122/35 |
| 4,479,869 | A | 10/1984 | Petterson et al. | | |
| 4,617,109 | A | 10/1986 | Wells et al. | | |
| 5,724,807 | A * | 3/1998 | Schuetzenduebel | F01K 3/247 | 60/39.182 |
| 2004/0200222 | A1 * | 10/2004 | Marin | F22B 31/00 | 60/679 |
| 2009/0158737 | A1 | 6/2009 | Klavers et al. | | |
| 2009/0301935 | A1 | 12/2009 | Spicer et al. | | |

FOREIGN PATENT DOCUMENTS

| | | | | |
|---|---|---|---|---|
| CN | 1239938 | | 12/1999 | |
| CN | 1245480 | | 2/2000 | |
| CN | 1476475 | | 2/2004 | |
| CN | 1957068 | | 5/2007 | |
| CN | 102382680 | | 3/2012 | |
| FR | 2828731 | | 2/2003 | |
| GB | 674583 | A * | 6/1952 | F22D 1/12 |
| JP | S57176309 | A | 10/1982 | |
| JP | H0835406 | A | 2/1996 | |
| JP | WO 2014013559 | A1 * | 1/2014 | F01K 13/02 |
| WO | 2005113713 | | 12/2005 | |
| WO | 2011094169 | | 8/2011 | |

* cited by examiner

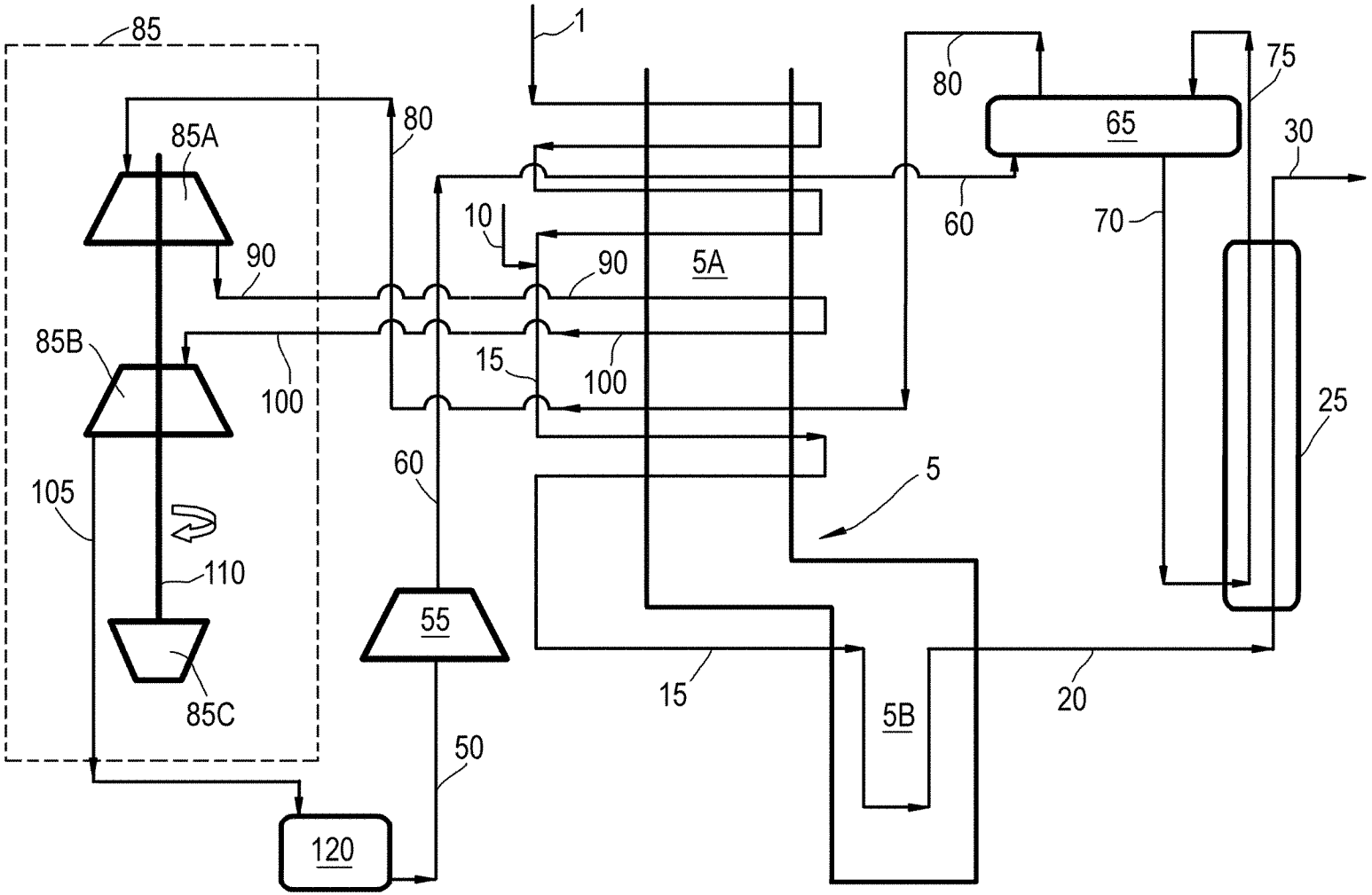
1
5
5A
5B
10
15
20
25
30
50
55
60
65
70
75
80
85
85A
85B
85C
90
100
105
110
120

PROCESS FOR RECOVERING POWER IN A PROCESS FOR PRODUCING ETHYLENE

PRIORITY CLAIM

The present application is the National Stage (§ 371) of International Application No. PCT/EP2013/066,202, filed Aug. 1, 2013, which claims priority from European Patent Application No. 12179210.5, filed Aug. 3, 2015.

FIELD OF THE INVENTION

This invention relates to a process for recovering power in a process for producing ethylene.

BACKGROUND TO THE INVENTION

Ethylene is typically produced by a process referred to as steam cracking, wherein a hydrocarbon feedstock is converted into an ethylene-containing cracked gas product. Ethylene is produced by cracking a feed mixture of dilution steam and hydrocarbon feedstock in the radiant zone of a cracking furnace. The feed mixture is preheated in the convection zone of the cracking furnace, wherein it is in heat exchange contact with flue gasses from the radiant zone, thereby recovering heat from the flue gas, and subsequently enters the radiant zone. The cracked gas product comes out of the radiant zone of the cracking furnace at elevated temperatures and is cooled against water in a heat exchanger, typically referred to as an indirect quench exchanger (IQE which are sometime called transfer line exchangers (TLE or TLX), selective linear exchangers (SLE), primary, secondary, tertiary, etc. quench exchangers (PQE/SQE/TQE/etc.), or ultra-selective exchangers (USX)). Saturated steam is produced in the IQE by quenching the cracked gas product.

The cracked gas product is subsequently separated in a separation process, which includes one or more compression and refrigeration steps.

In a conventional steam cracking unit, also referred to an ethylene cracker unit, steam expansion turbines are used to drive the cracked gas compressor and the refrigeration compressors. The required steam is generated in the in the indirect quench exchangers (IQE) as well as boiler coils in the furnaces and heaters.

In US 2009/0158737, a process for recovering power from steam cracking processes is described. In the process of US 2009/0158737, a multistage expansion turbine system is proposed to increase the efficiency to the power recovery. In US 2009/0158737, two turbine stages are provided. Medium pressure steam exiting the first stage is reheated by heat exchange against high pressure steam provided to the first turbine stage and the reheated medium pressure steam is provided to the second turbine stage. The heat required to reheat the medium pressure steam is provided by superheating the high pressure steam retrieved from the IQE in the convection section of the cracking furnace to temperatures above those normally required to superheat the high pressure steam for purposes of driving a steam turbine.

A disadvantage of the process of US 2009/0158737 is that steam cracking furnaces including utilities provided for handling the high pressure steam are typically operated at their maximum design limits. In order to allow the handling of superheated steam at temperatures normally used, special alloys are employed for piping and heat exchanger. In the process of US 2009/0158737, the superheated steam is heated to even higher temperatures, either requiring the use of alloys that can handle the higher temperatures resulting in increased CAPEX or accepting a significantly shorter lifetime of the heat exchangers and piping. Moreover, the process of US 2009/0158737 requires multiple heat exchange steps, leading to loss of energy efficiency and increased CAPEX. At least one of these heat exchange steps will include a heat exchange between two streams having a significant pressure difference. As described in Example 2 (Example of the Present Invention, with reference to FIGS. 2 and 3,) of US 2009/0158737 the superheated high pressure steam 30 (70 in FIG. 3) is heat exchanged with a medium pressure stream 37 (76 in FIG. 3), whereby the pressure difference between stream 30 and 37 (70 and 76 in FIG. 3) is more than 80 bar. Such a high pressure difference puts significant restriction on the design and material choice of the heat exchanger in particular at temperature over 585° C., leading to increased CAPEX.

There is a need in the art for a more efficient process for power recovery in a process for producing ethylene.

SUMMARY OF THE INVENTION

It has new been found that it is possible to increase the efficiency of a process for power recovery in a process for producing ethylene by using a reheat steam turbine and by reheating the medium pressure steam exiting the first stage of the steam expansion turbine in the convection zone of the cracking furnace.

Accordingly, the present invention provides a process for power recovery in a process for producing ethylene, comprising the steps of:

a) steam cracking a hydrocarbon feed in a cracking furnace at temperatures above 1000° C. to produce a cracked gas product having a temperature in the range of from 700 to 1000° C.;
b) cooling the cracked gas product by indirect heat exchange with high pressure liquid water having an initial temperature above 270° C. and an initial pressure above 65 bar (gauge) to obtain cooled cracked gas product while evaporating the high pressure liquid water to high pressure steam having a pressure above 65 bar (gauge);
c) expanding at least part of the high pressure steam in a first steam expansion turbine to produce power and to obtain medium pressure steam having a reduced temperature and reduced pressure compared to the high pressure steam;
d) heating at least part of the medium pressure steam to increase the temperature of the medium pressure steam by in the range of from 40 to 100° C. by passing the medium pressure steam through a convection zone of the cracking furnace and retrieving reheated medium pressure steam from the convection zone;
e) expanding at least part of the reheated medium pressure steam in a second steam expansion turbine to produce power and to obtain low pressure steam having a reduced pressure compared to the reheated medium pressure steam.

The process according to the invention does not require an additional heat exchanger to cool high pressure steam provided to the first steam expansion turbine with medium pressure steam exiting the first steam expansion turbine. This has the additional advantage that the high pressure steam can be provided at a temperature suitable for direct provision to the steam turbine, without having to rely on an intermediate heat exchanger step. This also reduces the risk damage to the first steam turbine due to disruptions in the heat exchanger, leading to high pressure steam being provided to the first turbine at a too high temperature.

The need to super heat the high pressure steam above temperatures needed for the first turbine is removed, thereby also removing the need to use piping and other utilities that can withstand temperatures above those required for the first steam turbine.

This increases the efficiency of the process by removing at least one heat exchange step.

BRIEF DESCRIPTION OF THE DRAWINGS

FIG. 1 provides a schematic representation of an embodiment of a process for producing power, according to the invention.

DETAILED DESCRIPTION OF THE INVENTION

Ethylene is produced by a thermal cracking process, wherein a mixture of dilution steam and a hydrocarbon feed, also referred to as the feed mixture, is provided to the cracking process and the hydrocarbon feed is cracked to produce, amongst other lower hydrocarbons, ethylene. This thermal cracking process is generally referred to as steam cracking or ethylene cracking. A steam cracking unit (or ethylene cracking unit) generally comprises a cracking furnace that produces the heat required to crack the hydrocarbon feed. Cracking furnaces for producing ethylene are well known in the art and contain a radiant zone for cracking the hydrocarbon feed in the feed mixture. The cracking furnace also contains a convection zone, wherein flue gas from the furnace is used to (pre)heat other streams including the dilution steam and the hydrocarbon feed. The streams provided to the cracking furnace pass through the radiant and convention zones through pipes and are heated by indirect heat exchange. Typically, the feed mixture is preheated in the convection zone, recovering heat from the flue gas, and then enters the radiant zone. As the flue gas passes through the convection zone, the heat exchange causes the flue gas to cool. The cooling of the flue gas, as it passes through the convection zone, creates a temperature profile in the convection zone, whereby the temperature is reduced in a direction away from the radiant zone. During operation of the process the feed mixture is, and, where desired, other fluids are (pre)heated in the convection zone by passing them through selected sections of the convection zone, where the temperature is most suitable for the desired extent of heating.

In the radiant zone of the cracking furnace, the hydrocarbon feed in the feed mixture is cracked in a radiant box with a temperature above 1000° C. and preferably at a temperature in the range of from 1000 to 1250° C. A cracked gas product is produced, which is retrieved from the radiant zone having a temperature in the range of from 700 to 1000° C., preferably, in the range of from 750 to 900° C. If the temperature of cracked gas product is too high, more relatively invaluable methane and coke is produced. Whereas, at low temperatures, low cracking yields are obtained.

The cracked gas product is subsequently cooled. Preferably, the cracked gas product is cooled by indirect heat exchange in an IQE (indirect quench exchanger). Reference herein to indirect heat exchange is to a heat exchange between two or more fluids, wherein the fluids are not in direct contact or mixed.

The cracked gas product is cooled by indirect heat exchange with high pressure liquid water. The high pressure liquid water has an initial temperature above 270° C., preferably an initial temperature in the range of from 270 to 350° C., and an initial pressure that is above the equilibrium pressure of the water at the initial temperature conditions. The initial pressure is above 65 bar (gauge), preferably the initial pressure is in the range of from 65 to 150 bar (gauge), more preferably of from 110 to 130 bar (gauge). Reference herein to an initial temperature and an initial pressure of a fluid is to the temperature and pressure at which a fluid is provided to a process step.

After the cracked gas is cooled, a cooled cracked gas product is obtained. This cracked gas product comprises ethylene; however it also comprises steam and a multitude of hydrocarbon species. The cooled cracked gas product is therefore subsequently separated in a separation process, typically including several separation and purification steps to isolate specific products, including ethylene, from the cooled cracked gas product. During the separation process, at least parts of the cooled cracked gas product are subjected to one or more compression steps and one or more refrigeration steps. For instance, a cracked gas compressor is used to compress at least part the cooled cracked gas. The compressor is commonly driven by a steam expansion turbine, which in turn generates the power to drive the compressor by expanding high pressure steam.

In the process according to the invention, power suitable to be used to drive amongst others one or more gas compressors, including the cracked gas compressor and one or more refrigeration compressor is produced. Alternatively, the power produced may be used to generate electricity, which in turn may be used to drive electric compressors utilities or be exported.

In step (b) of the process the cracked gas product is cooled by indirect heat exchange with high pressure water. In heat exchange contact with the cracked gas product, the high pressure liquid water evaporates and high pressure steam is obtained. Preferably, the high pressure steam is obtained essentially at the boiling temperature of the high pressure water following the heat exchange with the cracked gas product, i.e. within a range of from 25° C., preferably of from 10° C., above the boiling temperature of the high pressure water. It is preferred to evaporate more high pressure water, rather than to heat the high pressure steam to higher temperatures. On a weight basis the evaporation of the high pressure water is a more efficient way to cool the cracked gas product due to the high heat of evaporation. At the same time more high pressure steam can be produced.

The high pressure steam obtained in step (b) has a pressure, which is preferably at least the pressure of the high pressure water provided to step (b), corrected for any pressure drop experienced in the heat exchange of step (b). The high pressure steam obtained in step (b) has at least a pressure above 65 bar (gauge), preferably a pressure in the range of from 65 to 150 bar (gauge), more preferably 110 to 130 bar (gauge). Higher pressures are preferred in view subsequent expansion of the high pressure steam in a steam expansion turbine to produced power. If the pressure of the high pressure steam is too low the efficiency of steam expansion turbine is reduced. If the pressure is too high this may lead to damage to the steam expansion turbine.

At least part, and preferably all, of the high pressure steam produced in step (b) is subsequently provided to a first steam expansion turbine to be expanded to produce power. As mentioned herein above, the high pressure steam obtained step (b) has a temperature that is equal to slightly above the boiling temperature of the high pressure water. Optionally, the temperature of the high pressure steam is further increased by passing the high pressure steam through the convection zone of the cracking furnace to further heat, also referred to as superheating, the high pressure steam. Preferably, the high pressure steam that is expanded in step (c) has a temperature above 400° C., preferably a temperature in the range of from 400 to 600° C., more preferably of from 420 to 575° C.

In the first steam expansion turbine, the high pressure steam is expanded to produce power. The high pressure steam is expanded in the first steam expansion turbine, causing a reduction of the pressure of the high pressure steam. The high pressure steam is expanded to a pressure that is below the pressure of the high pressure steam, which was initially provided to the first steam expansion turbine. As the high pressure steam expands in the steam expansion turbine, the temperature of the steam is reduced. The extent of the pressure drop over the first steam expansion turbine depends on the operation conditions of the steam expansion turbine as well as the design of the steam expansion turbine. Preferably, the pressure drop over the steam expansion turbine caused by the expansion of the high pressure steam is controlled in the range of from 50 to 100 bar, more preferably in the range of from 60 to 90 bar. Preferably, the temperature drop over the first steam expansion turbine caused by the expansion of the high pressure steam is in the range of from 50 to 200° C., more preferably in the range of from 75 to 150° C.

As mentioned hereinabove, by expanding the high pressure steam, the pressure and temperature of the steam is reduced. Therefore, a medium pressure steam is obtained from the steam expansion turbine. The medium pressure steam has a reduced temperature and reduced pressure compared to the high pressure steam, which was initially provided to the first steam expansion turbine. Preferably, the medium pressure steam as obtained from step (c) has a pressure of in the range of from 50 to 100 bar below the pressure of the high pressure steam, preferably of from 60 to 90 bar below the pressure of the high pressure steam. Preferably, the medium pressure steam obtained in step (c) has a temperature of in the range of from 50 to 200° C. below the temperature of the high pressure steam, preferably of from 75 to 200° C. below the temperature of the high pressure steam.

The medium pressure steam obtained in step (c) is subsequently reheated by heating the medium pressure steam in the convection zone of the cracking furnace. At least part of the medium pressure steam is heated to increase the temperature of the medium pressure steam, by in the range of from 40 to 100° C., more preferably 45 to 75° C., by passing the medium pressure steam through a convection zone of the cracking furnace and retrieving reheated medium pressure steam from the convection zone.

It is preferred that the medium pressure steam is not recompressed to increase the pressure of the medium pressure steam.

Preferably, the medium pressure steam is passed through a section of the convection zone of the cracking furnace, wherein the temperature of convection zone, i.e. the flue gas, is in the range of from 350 to 700° C., more preferably 425 to 600° C. In particular, the later temperature range of the section of the convection zone is suitable as it allows a sufficient temperature to heat the medium pressure steam, while at the same time reduces the risk of heating the medium pressure steam to undesired and unnecessarily high temperatures. Such too high temperatures could damage the second steam expansion turbine, and cause an inefficient use of the energy available in the convection zone.

Preferably, the reheated medium pressure steam has a temperature in the range of from 400 to 550° C. More preferably, the reheated medium pressure steam has a temperature in the range of from 440 to 475° C.

It is preferred to transfer sufficient heat from the convection zone to the medium pressure steam as to increase the enthalpy the medium pressure steam in the range of 100 to 150 MJ per ton of medium pressure steam provided to the second steam expansion turbine compared to a process, wherein the medium pressure steam is provided to the second steam expansion turbine in the absence of a reheating step.

If desired, part of the medium pressure steam may be withdrawn from the process and provided to the high or medium pressure steam header.

At least part, and preferably all, of the reheated steam is provided to a second steam expansion turbine to be expanded to produce further power. From the second steam expansion turbine a low pressure steam is obtained.

By heating the medium pressure steam to obtain the reheated medium pressure steam, efficiency of the power production is significantly increased, due to the well known principle that the efficiency of a Rankine cycle based power generation can be increased as the entry temperature is raised. At the same time it reduces or even prevents damage to the turbine blades caused by the formation of water droplets in the steam expansion turbine. Where water droplets are formed by condensation of steam inside the steam expansion turbine, droplets hit the turbine blades at the high speed causing pitting and erosion, gradually decreasing the life of turbine blades and efficiency of the steam expansion turbine. The tendency of steam to condense in the second steam expansion turbine is greatly reduced if not diminished when the steam is reheated after it has been expanded in the first steam expansion turbine.

In the process of the current invention, the medium pressure steam is reheated directly in the convection zone rather than by heat exchange with the high pressure steam. This removes the need to provide a heat exchange unit for heat exchange contacting the medium pressure steam with the high pressure steam. In addition, the process is less sensitive to changes in the temperature and volume of the available high pressure steam. Where in prior art processes there is a risk that the high pressure steam is not sufficiently cooled by heat exchange with the medium pressure steam, leading to damaging of the steam expansion turbine, the present process allows for the provision of the high pressure steam directly at a temperature that is optimal for the first steam expansion turbine.

Moreover, due to the broad temperature profile in the convection zone, the process may be designed for a broad range of temperatures of the reheated medium pressure steam by selection of the appropriate section of the convection zone during the design of the process.

The power produced is preferably used to drive one or more cracked gas compressors and/or one or more refrigeration compressors. More preferably the one or more cracked gas compressors and/or one or more refrigeration compressors are used to compress or cool at least part of the cooled cracked gas obtained after the cracked gas product was cooled by heat exchange with the pressurized water, preferably in an IQE. The recovery and purification of light olefins such as ethylene and propylene from the cracked gas product is an energy intensive process. A typical ethylene recovery and purification section comprises a cracked gas compressor to compress the cooled cracked gas process, optionally after removal of the dilution steam from the cooled cracked gas product to a relatively high pressure, typically in the range of from 14 to 35 bar (gauge). The ethylene contained in the compressed cracked gas product is then typically recovered and purified through cryogenic distillation, including de-ethanizer and de-methanizer columns. Such distillation steps are typically cryogenic in nature, carried out at temperatures below ambient temperature, requiring significant refrigeration.

In step (e) of the process low pressure steam is produced. The low pressure steam may be used for any suitable purpose, however, it is preferred to condense the low pressure steam to liquid water, which is pressurized and subsequently heated to form at least part of the high pressure liquid water provided to step (b). Preferably, the liquid water obtained by condensing the low pressure steam, generally referred to as boiler feed water, is pressurised to a pressure in the range of from 65 to 150 bar (gauge), preferably 110 to 130 bar (gauge), and passed through a section of the convection zone. Preferably, the temperature at which the liquid water obtained by condensing the low pressure steam, which is provided to the section of the convection zone, is in the range of from 90 to 240° C. prior to entering the section of the convection zone. The liquid water obtained by condensing the low pressure steam is preferably preheated in a section of the convection zone where the flue gas has a temperature in the range of from 140 to 300° C. The temperature of the heated, pressurized water may be further increased by contacting directly or indirectly the heated pressurized water with the high pressure steam obtained in step (b). Preferably, the heated pressurized water is contacted directly with the high pressure steam obtained in step (b) in a steam drum, which contains a saturated steam phase and a water phase.

The steam expansion turbines used in the process of the present invention may be any steam expansion turbine, also referred to as reheat steam expansion turbine, suitable for expanding high pressure, high temperature steam with intermediate reheat of the medium pressure steam passing from the first to the second turbine stage. Such steam expansion turbines are well known in the art. The power produced can be converted into electricity to power electric compressors; however, preferably the turbine is mechanically connected to the compressor via a drive shaft.

The first and second steam expansion turbines may be separate steam expansion turbines; however, preferably they are separate stages of a single reheat steam expansion turbine system.

The hydrocarbon feed to the process may be any suitable hydrocarbon feed to produce ethylene. Preferably, the hydrocarbon feed includes at least one of ethane, propane, butane and other paraffinic hydrocarbons and mixtures of hydrocarbons such as condensate, LPG, natural gas liquids (NGL), naphtha, gas oil, vacuum gas oil, hydrowax and synthetic hydrocarbons such as Fischer-Tropsch hydrocarbons, in particular C3 to C10 Fischer-Tropsch paraffins.

DETAILED DESCRIPTION OF THE DRAWINGS

In FIG. 1, a schematic representation of an embodiment of a process for producing power according to the invention is provided. In this process, hydrocarbon feed 1 is preheated by passing hydrocarbon feed 1 through convection zone 5A of cracking furnace 5. At a certain stage, dilution steam 10 is added to hydrocarbon feed 1 to form feed mixture 15. Diluent steam 10 may have been preheated prior to mixing dilution steam 10 with hydrocarbon feed 1 (not shown). Feed mixture 15 is further pre-heated by passing feed mixture 15 through convection zone 5A of cracking furnace 5 and subsequently passing feed mixture 15 through radiant zone 5B of cracking furnace 5. In radiant zone 5B of cracking furnace 5, the hydrocarbon feed in feed mixture 15 is cracked and cracked gas product 20 is obtained from radiant zone 5B of cracking furnace 5. Cracked gas product 20 is provided to IQE 25 and cooled to provide cooled cracked gas product 30, which may be provided to a separate separation and purification section (not shown).

Boiler feed water 50 is pressurised to provide high pressure liquid water, having a pressure above 65 bar (gauge), in pump 55. High pressure liquid water 60 is passed through convection zone 5A of cracking furnace 5 to heat high pressure liquid water 60 to a temperature of approximately 270° C. or higher. Subsequent to heating high pressure liquid water 60, high pressure liquid water 60 is passed to steam drum 65, which comprises saturated high pressure steam and high pressure liquid water. From steam drum 65, high pressure liquid water 70 is passed to IQE 25, where it evaporates in indirect heat exchange contact with cracked gas product 20. High pressure steam 75 exits IQE 25 and is passed to steam drum 65. From steam drum 65, high pressure steam 80 is passed through convection zone 5A of cracking furnace 5 to be super heated and is subsequently provided to reheat steam expansion turbine system 85. In reheat steam expansion turbine system 85, high pressure steam 80 is provided to first steam expansion turbine 85A, wherein high pressure steam 80 is expanded to provide medium pressure steam 90, which exits steam expansion turbine 85A. Medium pressure steam 90 is passed through convection zone 5A of cracking furnace 5 to be reheated to provide reheated medium pressure steam 100. Preferably, medium pressure steam 90 is passed through a section of convection zone 5A of cracking furnace 5, wherein the temperature of the convection zone is in the range of from 350 and 700° C. Reheated medium pressure steam is passed back to reheat steam expansion turbine system 85. In reheat steam expansion turbine system 85, reheated medium pressure steam 100 is provided to second steam expansion turbine 85B, wherein reheated medium pressure steam 100 is expanded to provide low pressure steam 105, which exits steam expansion turbine 85B. First and second steam expansion turbines 85A and 85B produce power, which may be used to compress a gaseous stream, for example a gaseous stream comprising part or all of cooled cracked gas product 30, in compressor 85C. The power produced by first and second steam expansion turbines 85A and 85B may be provided in the form of electricity to drive compressor 85C or mechanically via a common shaft 110.

Low pressure steam 105 exits turbine system 85 and is provided to condenser 120, wherein the low pressure steam is condensed to provide boiler feed water 50.

That which is claimed is:

1. A process for power recovery in a process for producing ethylene, comprising the steps of:

a) steam cracking a hydrocarbon feed in a cracking furnace at temperatures above 1000° C. to produce a cracked gas product having a temperature in the range of from 700 to 1000° C.;

b) cooling the cracked gas product by indirect heat exchange with high pressure liquid water having an initial temperature above 270° C., an initial pressure above 65 bar (gauge) and a boiling point to obtain cooled cracked gas product while evaporating the high pressure liquid water to high pressure steam having a pressure above 65 bar (gauge) wherein the high pressure steam is at a temperature of the boiling point of the high pressure liquid water;

c) expanding at least part of the high pressure steam in a first steam expansion turbine to produce power and to obtain medium pressure steam having a reduced temperature and reduced pressure compared to the high pressure steam wherein the high pressure steam is not superheated before it is expanded in the first steam expansion turbine;

d) heating at least part of the medium pressure steam to increase the temperature of the medium pressure steam by in the range of from 40 to 100° C. by passing the medium pressure steam through a convection zone of the cracking furnace and retrieving reheated medium pressure steam from the convection zone;

e) expanding at least part of the reheated medium pressure steam in a second steam expansion turbine to produce power and to obtain low pressure steam having a reduced pressure compared to the reheated medium pressure steam.

2. The process according to claim 1, wherein at least part of the low pressure steam obtained in step (e) is condensed to liquid water, which is pressurised and subsequently heated to form at least part of the high pressure liquid water in step (b).

3. The process according to claim 1, wherein the high pressure water is produced by passing pressurised liquid water, having a temperature of the range of from 90 to 240° C. and a pressure in the range from 65 to 150 bar (gauge), through a section of the convection zone.

4. The process according to claim 1, wherein the hydrocarbon feed is cracked in a radiant zone of the cracking furnace at a temperature in the range of from 1000 to 1250° C.

5. The process according to claim 1, wherein the hydrocarbon feed comprises at least one of ethane, propane, butane (liquefied petroleum gasses or LPG), paraffinic hydrocarbons and mixtures of hydrocarbons selected from the group consisting of condensate, natural gas liquids (NGL), naphtha, gas oil, vacuum gas oil, hydrowax, synthetic hydrocarbons, Fischer-Tropsch hydrocarbons and mixtures thereof.

6. The process according to claim 1, wherein the high pressure water in step (b) has an initial temperature of in the range of from 270 to 340° C. and an initial pressure in the range from 65 to 150 bar (gauge).

7. The process according to claim 1, wherein the high pressure steam obtained in step (b) has a pressure in the range from 65 to 150 bar (gauge).

8. The process according to claim 1, wherein the high pressure steam expanded in step (c) has an initial temperature above 400° C.

9. The process according to claim 1, wherein the medium pressure steam obtained in step (c) has a pressure of in the range of from 50 to 100 bar below the pressure of the high pressure steam.

10. The process according to claim 1, wherein the medium pressure steam obtained in step (c) has a temperature of in the range of from 50 to 200° C. below the temperature of the high pressure steam.

11. The process according to claim 1, wherein the medium pressure steam is passed to a section of the convection zone wherein the temperature of the convection zone is in the range of from 350 and 700° C.

12. The process according to claim 1, wherein the reheated medium pressure steam obtained in step (d) has a temperature of in the range of from 400 to 550° C.

13. The process according to claim 1, wherein the medium pressure steam is heated in step (d) to increase the enthalpy of the medium steam by in the range of from 100 to 150 MJ per ton of reheated medium pressure steam in the convection zone.

14. The process according to claim 1, wherein at least part of the power produced in steps (c) and (e) is used to drive one or more cracked gas compressors and/or one or more refrigeration compressors.

15. The process according to claim 14, wherein the one or more cracked gas compressors and/or one or more refrigeration compressors are used to compress or cool at least part of the cooled cracked gas.

* * * * *